US005575233A

United States Patent [19]

Walker

[11] Patent Number: 5,575,233

[45] Date of Patent: Nov. 19, 1996

[54] MONOPLANE AND LOW THRUST WINGSAIL ARRANGEMENTS

[76] Inventor: John G. Walker, Tipwell House, St Mellion, Cornwall PL12 6RS, Great Britain

[21] Appl. No.: 381,192

[22] Filed: Jan. 31, 1995

[30] Foreign Application Priority Data

Jan. 31, 1994 [GB] United Kingdom ..... 9401744

[51] Int. Cl.[6] ..... B63H 9/06

[52] U.S. Cl. ..... 114/102; 114/103

[58] Field of Search ..... 114/103, 102, 114/167; 244/87, 215

[56] References Cited

U.S. PATENT DOCUMENTS 4,543,899 10/1985 Walker ..... 114/102

*Primary Examiner*—Sherman Basinger
*Attorney, Agent, or Firm*—Iandiorio & Teska

[57] ABSTRACT

A wingsail assembly comprising a thrust wing having a leading aerofoil (1) and a trailing aerofoil (2), the leading and trailing aerofoils being deflectable with respect to one another to adopt a cambered configuration, characterised in that the trailing aerofoil has a cross-sectional shape with a relatively flat leading edge interconnecting relatively strongly curved corners (5,6) on opposite sides of the aerofoil, such that for each direction of relative deflection between the leading and trailing aerofoils the corner more remote from the trailing edge of the leading section provides an aerodynamic leading edge for the trailing section and the corner more proximate the trailing edge of the leading section provides an inner wall for a convergent slot. The assembly is mounted on a vessel via a bearing having an axis passing through the trailing section. A tail aerofoil trims the assembly and is mounted on a boom extending from the trailing section.

5 Claims, 6 Drawing Sheets

MONOPLANE AND LOW THRUST WINGSAIL ARRANGEMENTS

This invention relates to wingsails for the propulsion of marine vessels, and in particular but not exclusively to monoplane wingsails of the self-trimming type.

BACKGROUND OF THE INVENTION

Self-trimming wingsails of the general type to which this invention relates are variously described in applicant's earlier patent specifications such as U.S. Pat. No. 4,467,741 and U.S. Pat. No. 4,563,970. The wingsail basically consists of one or more thrust wings, each wing having a leading and trailing aerofoil section. The aerofoils are preferably of symmetrical cross-section. Previously the leading section has been mounted to the vessel for free rotation on an upright axis and the trailing section has been pivoted to the leading section about a spanwise axis so that it could be deflected from side to side to create mirror image cambered wing configurations for sailing on opposite tacks. An air directing slat has been positioned at the trailing edge of the leading section to define an aerodynamic slot between the leading section and the deflected trailing section.

The thrust wing or wings have been trimmed about the main upright axis by a tail aerofoil extending downstream from the wing.

With such an arrangement, the tail control has proved satisfactory at large angles of attack for providing high levels of thrust, but at lower angles of attack with the trailing section deflected, airflow through the slot has tended to separate, giving reduced control by the tail aerofoil which can become engulfed by disturbed airflow. The level of control worsens as the trust level is reduced, until at around the important zero thrust or neutral position, that is when zero crosswind force is developed, control may be lost altogether. Zero crosswind force means that there is zero thrust and no force is developed across the direction of the wind. The problem may be overcome in multi thrust wing wingsails as a single tail aerofoil may be offset between the two planes of, for example, a biwing wingsail. However the problem remains for monoplane thrust wings.

SUMMARY OF THE INVENTION

The present invention is directed towards providing a wingsail aerofoil arrangement and profile that enables lower angles of attack to be achieved without loss attachment of airflow through the slot. The invention is also directed towards providing an arrangement that enables a tail aerofoil to function in clear air.

Accordingly the invention provides a wingsail assembly comprising a thrust wing having a leading aerofoil and a trailing aerofoil, the leading and trailing aerofoils being deflectable with respect to one another to adopt a cambered configuration, and having means enabling zero crosswind force to be achieved and maintained while the aerofoils remain deflected with respect to one another. It is the trailing section which is now preferably mounted to the vessel, and the leading section which is deflectable from side to side.

This has particularly useful application in wingsail assemblies where the tail aerofoil would otherwise become engulfed by disturbed airflow resulting in reduced levels of control.

In a preferred embodiment the means enabling zero crosswind force comprises a substantially flat portion at the leading edge of the trailing section interconnecting corners on opposite sides of the aerofoil, said corners being strongly curved and each providing, for a respective deflection of the leading and trailing aerofoils, an aerodynamic leading edge for the trailing section and an inner wall for a convergent slot.

A further aspect of the invention is that the tail aerofoil may be mounted on a boom or booms extending from the trailing aerofoil, rather than from the leading aerofoil. The assembly is also preferably mounted to the vessel on an axis extending through the trailing section.

A preferred embodiment of the invention comprises a wingsail assembly comprising a thrust wing having a leading aerofoil and a trailing aerofoil, the leading and trailing aerofoils being deflectable with respect to one another to adopt a cambered configuration and the wing being mounted for rotation about an upright axis under the control of a tail aerofoil, characterised in that the trailing aerofoil is shaped to enable substantially zero crosswind force to be achieved and maintained while the aerofoils remain deflected with respect to one another and the tail is mounted on a boom extending from the trailing section so that at a zero lift angle of attack, with the leading and trailing aerofoils deflected with respect to one another, the tail aerofoil is laterally offset from the main air flow over the wing.

A further aspect of the invention provides a wingsail assembly comprising a thrust wing having a leading aerofoil and a trailing aerofoil, the leading and trailing aerofoils being deflectable with respect to one another, in which the trailing aerofoil is mounted to a vessel for free rotation about an upright axis, the leading aerofoil pivoting about the trailing section, and the assembly further including a tail aerofoil for trimming the assembly, the tail being mounted on a boom extending from the trailing aerofoil.

BRIEF DESCRIPTION OF THE DRAWINGS

The invention is now described by way of example with reference to the accompanying drawings in which.

DETAILED DESCRIPTION OF PREFERRED EMBODIMENTS

Figure 1:
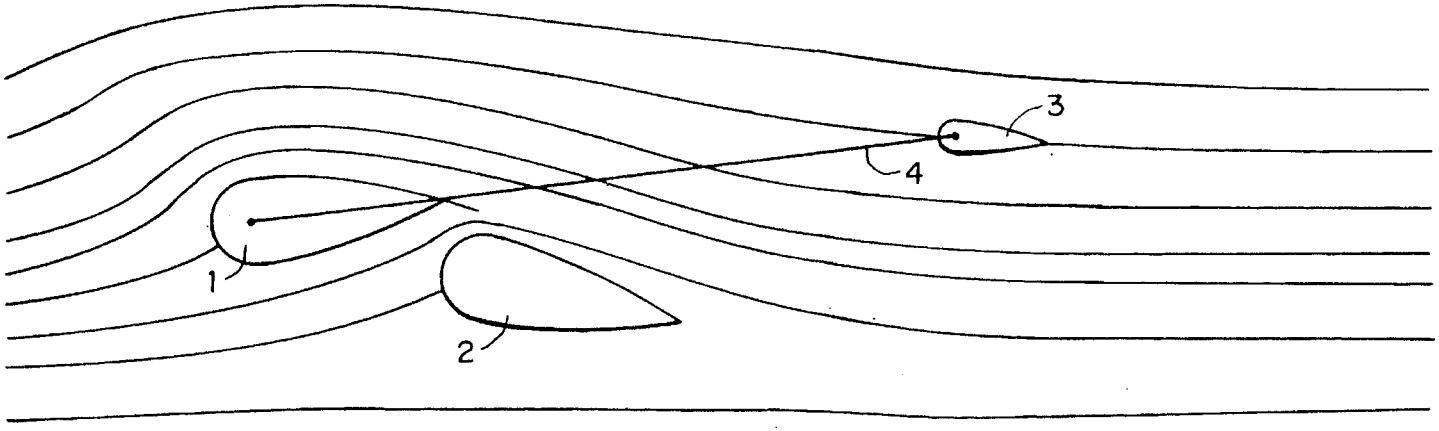
FIG. 1 PRIOR ART
FIG. 1 schematically illustrates a prior art wingsail trimmed for high thrust levels.
Figure 2:
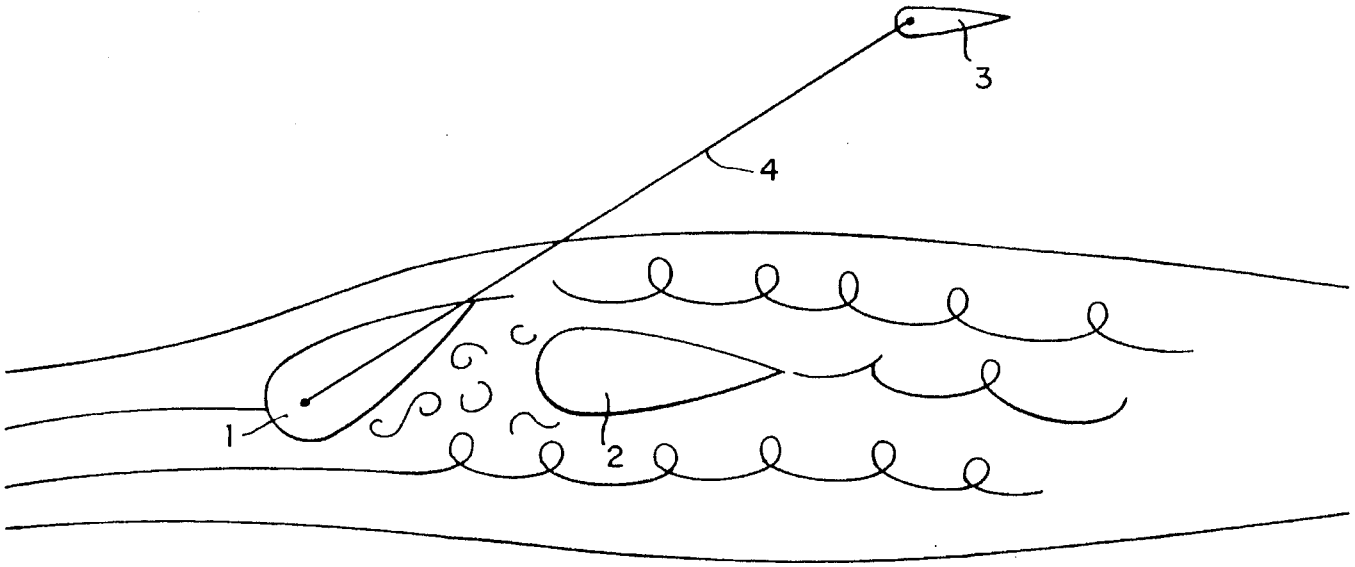
FIG. 2 PRIOR ART
FIG. 2 schematically illustrates the wingsail of FIG. 1 trimmed to a lower angle of attack.

Referring to the drawings, FIG. 1 illustrates a thrust wing having a leading section 1 and a trailing section 2, controlled by a tail 3 mounted on a boom 4 extending from the leading section. This prior art arrangement is satisfactory for the high thrust angle shown in FIG. 1. However, the air flow through the slot has tended to break down at the lower angles of attack, used for example when reduced levels of thrust are required. This may cause the air flow over the low pressure side of the trailing section to separate, seriously compromising the ability of the downstream aerodynamic tail to control the angle of attack and hence the thrust level of the device. Such an event is illustrated schematically in FIG. 2.

Figure 3:
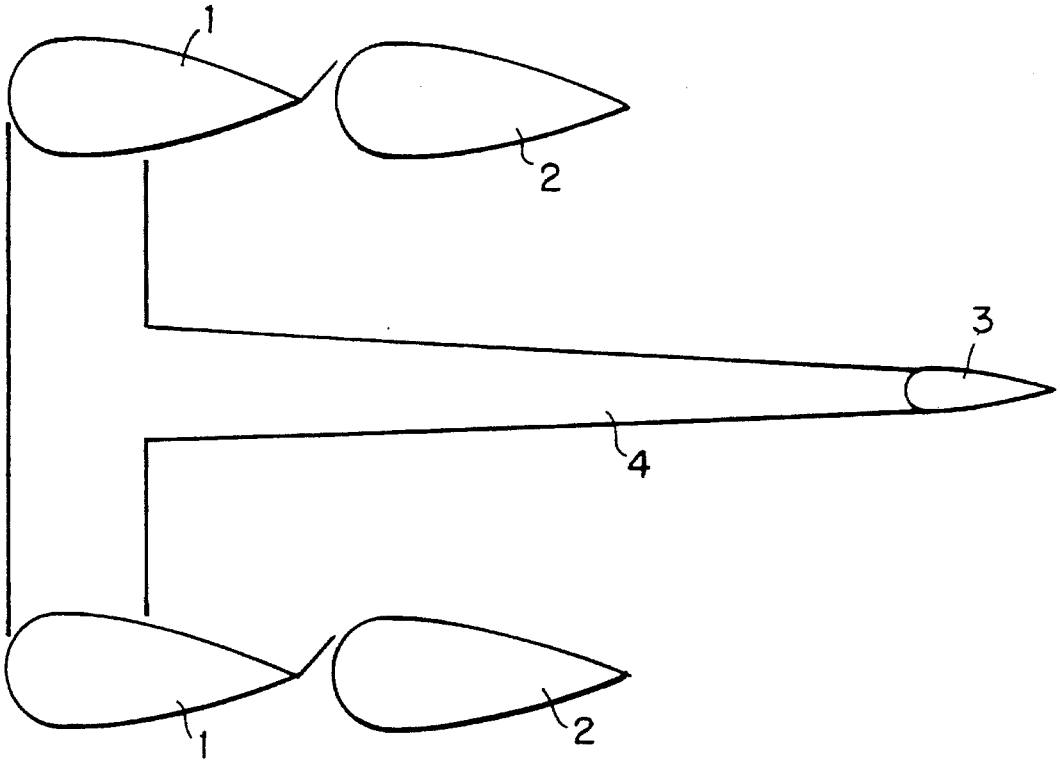
FIG. 3 PRIOR ART
FIG. 3 schematically illustrates a biwing arrangement.

This problem has been successfully overcome in previous wingsail arrangements by setting the leading section in line with the trailing section for operation at reduced thrust, and arranging the main thrust elements as two panels or wings disposed rather as in a biplane aircraft, controlled by a single centrally arranged downstream aerodynamic tail aerofoil. Such an arrangement is shown in FIG. 3. In this arrangement the tail 3 receives clear and undisturbed air flow passing between the two main thrust panels (each comprising a leading section 1 and trailing section 2), and its authority is adequate to control the thrust unit in terms of angle of attack, especially at and around the zero thrust level which is the important 'neutral' case for these propulsion units. It will be appreciated that larger multi-wing structures may also provide a tail or tails in undisturbed air flow between adjacent wings.

Figure 4:
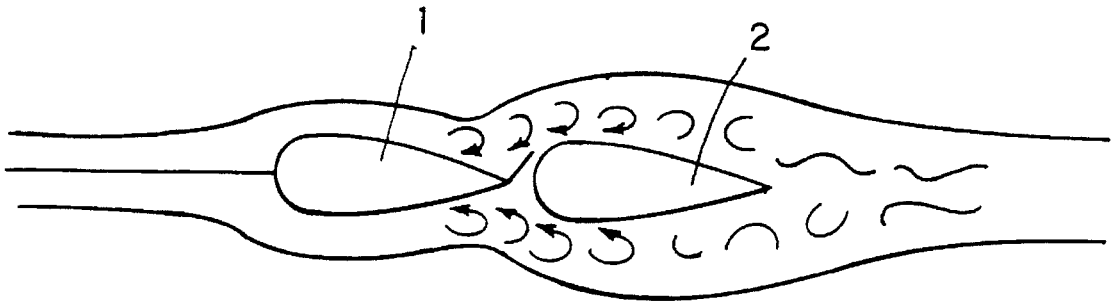
FIG. 4 PRIOR ART
FIG. 4 schematically illustrates a wing in an aligned, symmetrical configuration.
Figure 5:
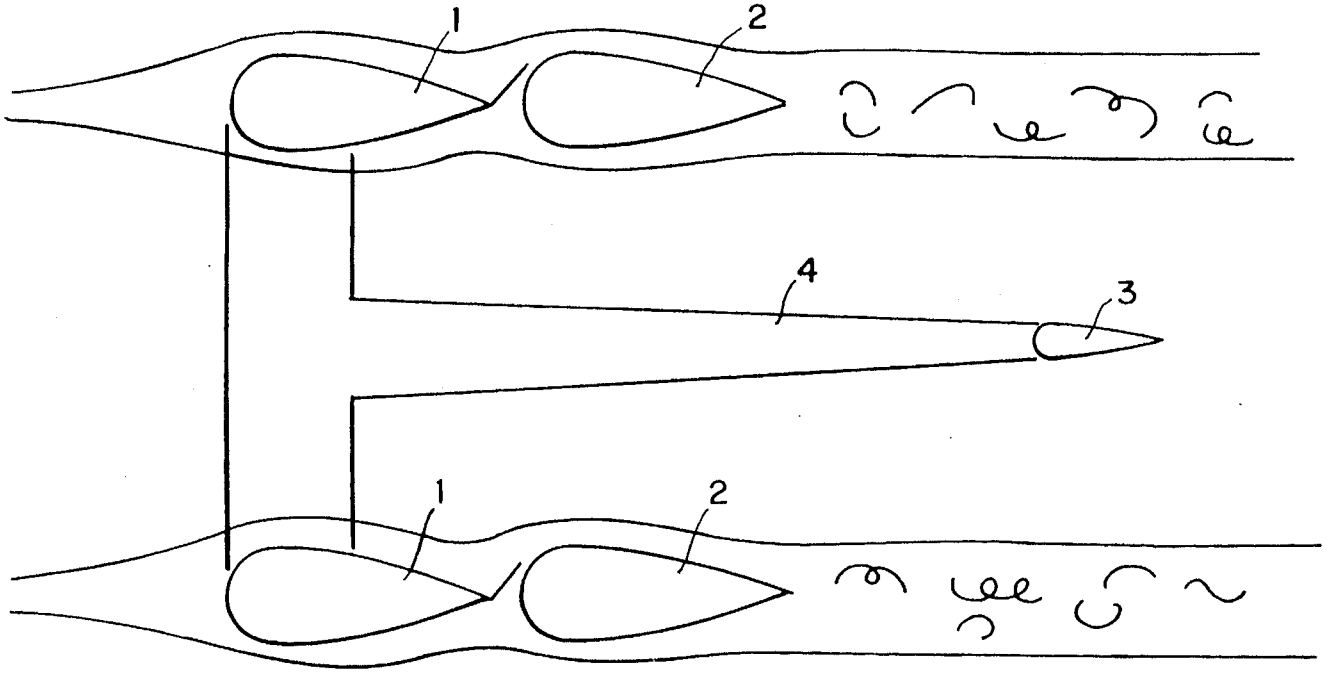
FIG. 5 PRIOR ART
FIG. 5 schematically illustrates a biwing in the symmetrical configuration.

However, the rather hourglass shaped aerofoil section produced by setting the leading and trailing sections in line tends to develop vortices with spanwise axes in the narrowed part of the overall section, which are rather erratically shed so as to create a somewhat diffused low energy wake downstream. This is illustrated schematically in FIG. 4. This airflow has no particular significance in a biwing design, since the aerodynamic drag is still quite low and the two wakes pass either side of the tail, which can operate at full efficiency in clear undisturbed air, as shown in FIG. 5.

Figure 6:
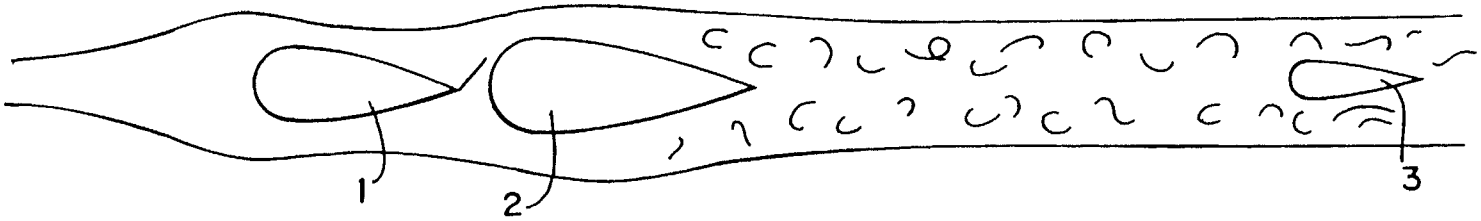
FIG. 6 PRIOR ART
FIG. 6 illustrates a monoplane in the symmetrical configuration.

Unfortunately, when a monowing or monoplane wingsail is proposed, as distinct from a biplane or other multiplane wingsail, with a single tail positioned for symmetry in the plane defined by the planes of symmetry of the leading and trailing sections when they are in line, the disturbed airflow caused by the aligned wing configuration also causes a problem. The eddying wake tends to envelope the tail, so that levels of control worsen as the thrust level is reduced, until at around the important zero thrust neutral position it may be lost altogether. This is shown in FIG. 6.

Such a wingsail, set in neutral, could erratically adopt quite large angles of attack, and therefore thrust levels, to left or right of the wind before the tail, emerging into clearer air, can return the unit towards zero thrust. Inertia could then make it quite likely that the unit would continue to swing right through the zero thrust angle of attack and out on the other side. A vessel fitted with such a wingsail could therefore surge about, uncontrollably and unacceptably.

Thus with a monoplane wingsail the problem of ensuring adequate tail control at low thrust angles remains.

The present invention arose after inspection and rejection of an obvious alternative, which is to divide the tail surface into two units in biplane format, disposed symmetrically on either side of the plane of symmetry of the monoplane thrust panel. The weight and complexity of this arrangement is unattractive, and alternative approaches were explored which have resulted in the present invention.

Figure 7:
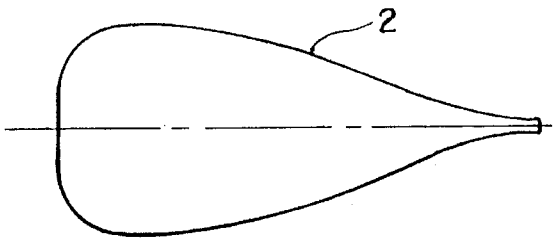
FIG. 7 illustrates a new profile for the trailing section of a wing.
Figure 9:
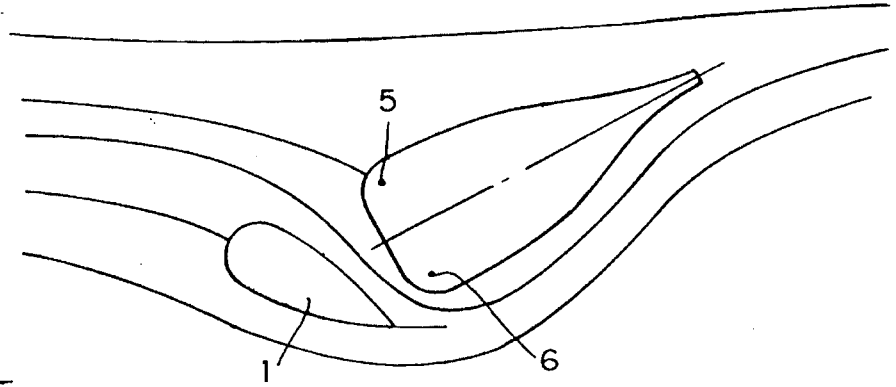
FIG. 9 is a mirror image illustration of FIG. 8.
Figure 8:
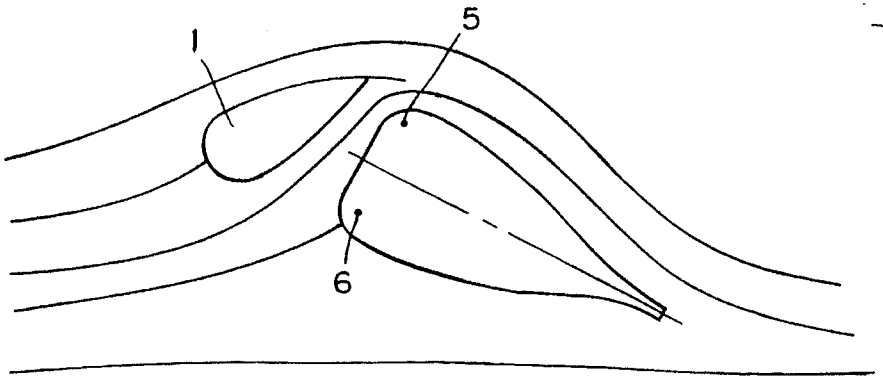
FIG. 8 illustrates flow around a wing incorporating the trailing section profile of FIG. 7.

A new and unorthodox aerodynamic profile for the trailing section, 2, was designed, with a broad and almost flat leading part. This produces a rather 'parsnip' shape with two separate relatively strongly curved, i.e. relatively low radius, 'leading corners' as shown in FIG. 7, rather than the expected single rounded or more pointed leading edge of a typical known aerofoil. Concomitant optimisation of the profile of the leading section 1, using the known device of an air directing slat, has produced an aerofoil section which can be set to provide zero crosswind force while the sections are still deflected with respect to each other into the asymmetrical arrangement that is also used for the maximum thrust case. When sailing on each tack, one of the leading corners of the parsnip shaped trailing section 2 is an aerodynamic leading edge and the second leading corner plays an important role as one wall of the convergent slot or linear nozzle. In FIG. 8 the corner reference 6 is acting as a leading edge while corner 5 is the wall of the slot. On the opposite tack the second leading corner, 5, becomes the aerodynamic leading edge and the first leading corner, 6, forms one wall of the linear nozzle, in the mirror image configuration shown in FIG. 9.

With the aerofoil configuration according to the invention the angle of attack can be reduced from that for full thrust right down to that for zero thrust with smooth and fully attached flow over all the surfaces including, very importantly, through the slot or linear nozzle. This low thrust can be achieved without having to reduce the relative angle between the aerofoils from the deflected configuration. There are still occasions when broadly coplanar settings of the main sections may be desired for low levels of thrust, and this mode of operation therefore remains an option.

The surface profiles are carefully chosen to optimise maximum thrust and minimum drag levels at high angles of attack; maximum values of thrust/drag at medium angles of attack; and minimum drag at zero thrust.

It will be appreciated that while the new aerofoil shape is particularly useful in overcoming the loss of tail control caused be detaching airflow in a monoplane arrangement, it may also find convenient application in multiplane arrangements.

Figure 10:
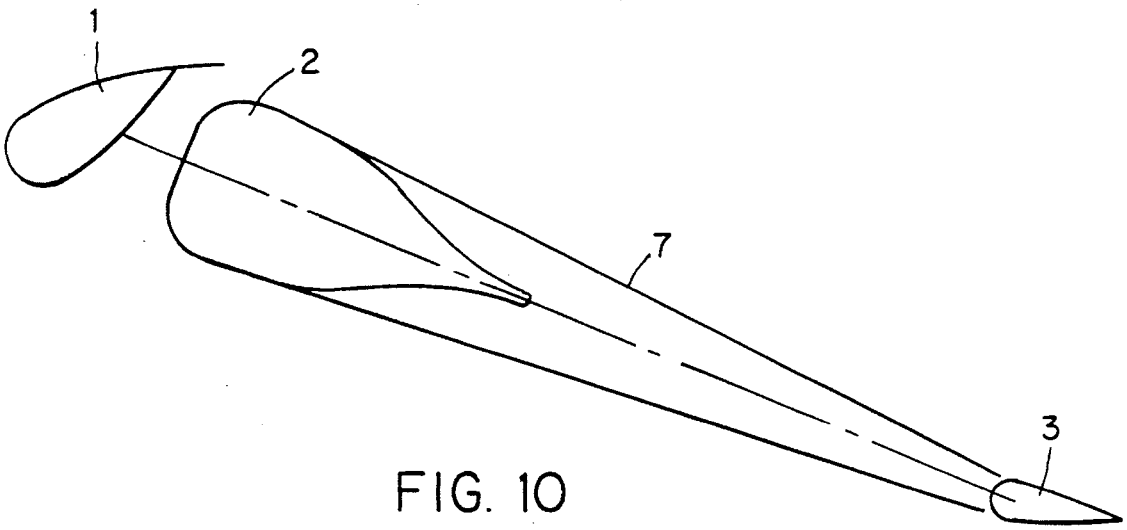
FIG. 10 illustrates the attachment of the tail to the trailing aerofoil.

In earlier designs the tail 3 has been supported downstream in the plane of symmetry of the leading section on a boom or booms 4 connected to the leading section. However, in the preferred monoplane embodiment of this invention shown in FIG. 10, the tail 4 may be supported downstream in the plane of symmetry of the trailing section, 2, on booms, 7, connected to the trailing section. This results in useful asymmetry, in that at the zero lift angle of attack with leading section deflected the tail boom offsets the tail to one side of the main air flow and in clear air, so that it can operate at maximum efficiency.

Figure 12:
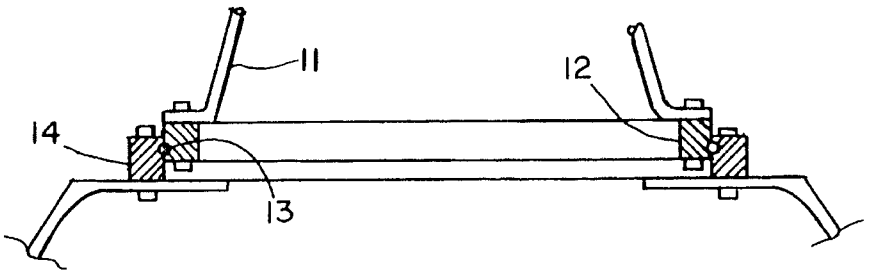
FIG. 12 illustrates detail of the main bearing axis of FIG. 11.
Figure 11:
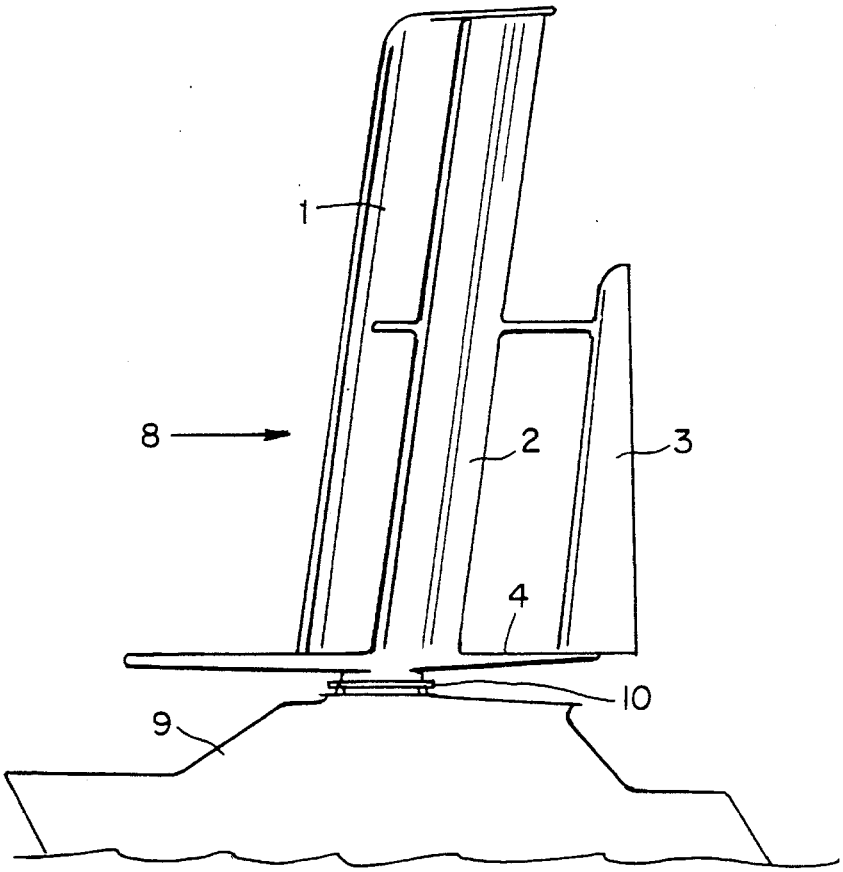
FIG. 11 illustrates the connection of the trailing section to the main bearing axis.

A further preferred modification to the wingsail arrangement, compared with earlier successful designs is in the wingsail mounting. Previously the wingsail has been mounted via a bearing to the driven vessel to be freely rotatable about an upright axis, the bearing being connected to the leading section or sections and with trimming of the wingsail, as in the present embodiment, being via a tail aerofoil. Referring now to FIG. 11, in this modification the wingsail 8, is mounted to the driven vessel, 9, through a free vertical axis bearing, 10, connected to the trailing section, 2, (of trailing sections in the case of a biplane or other multiplane) of the wingsail. FIG. 12 shows more detail of the bearing 10. The wingsail root, referenced 11, is mounted to an inner race 12 which rotates in outer race 13 via ball bearings 14. The outer race assembly is secured via bolts or other means to the deckhouse of the vessel.

This monoplane (or multiplane) wingsail trimmed by a single aerodynamic tail can produce high thrust with low drag at high angles of attack, high values of thrust/drag ratio at medium angles of attack, and the ability to reduce thrust progressively right down to zero crosswind force with full control and very low levels of drag, without alteration to the angle between the leading and trailing sections. Pinlocks used in earlier successful wingsails to lock the leading and trailing sections either in line or at some preset angle of deflection either side of the plane of symmetry may be eliminated, an irreversible or self locking actuator mechanism provided to move the sections relative to each other sufficing under the circumstances to maintain the desired setting.

Figure 13:
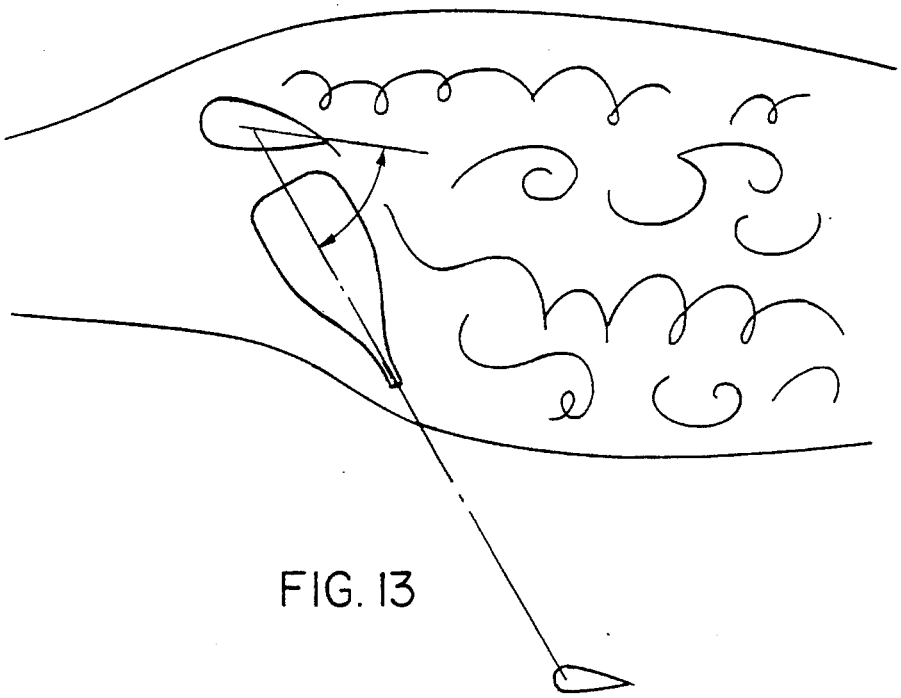
FIG. 13 illustrates a greater deflection angle achieved with the invention.
Figure 14:
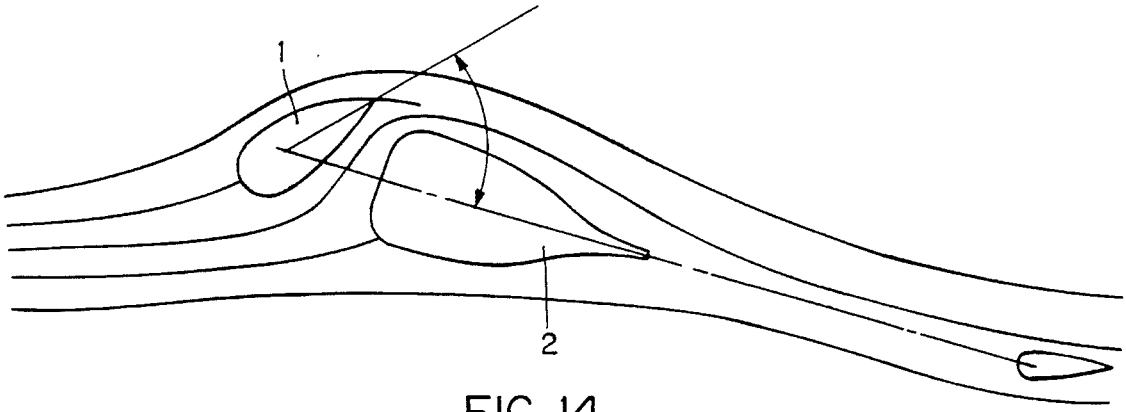
FIG. 14 illustrates a lower deflection angle suitable for running downwind.
Figure 15:
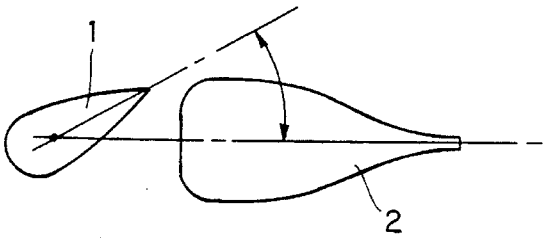
FIG. 15 illustrates a further reduction of the deflection angle.

With the present invention, the angle between the sections can be adjusted to any value desired, including the aligned position, independently of thrust setting, although there are interdependent optimum settings. For example a greater relative section angle can be chosen for maximum drag when running downwind, FIG. 13, and a smaller angle for lower thrust levels at greater aerodynamic efficiency, FIG. 14. Specifically, it may be advantageous to reduce the relative section angle when zero cross wind force is required, to reduce the slope of the lift curve at low angles of attack. This can reduce the levels of transient force produced by the wingsail when zero cross wind force is required with the leading and trailing sections deflected in the presence of significant variations or perturbations in the wind direction. Such a lower angle of deflection is shown in FIG. 15.

I claim:

1. A wingsail assembly comprising a thrust wing having a leading aerofoil (1) and a trailing aerofoil (2), the leading and trailing aerofoils being deflectable with respect to one another to adopt a cambered configuration, characterised in that the trailing aerofoil has a cross-sectional shape with a relatively flat leading edge interconnecting relatively strongly curved corners (5,6) on opposite sides of the aerofoil, such that for each direction of relative deflection between the leading and trailing aerofoils the corner more remote from the trailing edge of the leading aerofoil provides an aerodynamic leading edge for the trailing aerofoil and the corner more proximate the trailing edge of the leading aerofoil provides an inner wall for a convergent slot.

2. A wingsail assembly according to claim 1 in which the leading aerofoil is pivotable with respect to the trailing aerofoil.

3. A wingsail assembly according to claim 1 in which the assembly is mounted on a vessel via a main bearing, the assembly being pivotable about an upwright axis passing through the trailing aerofoil under the control of a tail aerofoil (3).

4. A wingsail assembly according to claim 3 in which the tail aerofoil is mounted on at least one boom extending from the trailing aerofoil.

5. A wing sail assembly according to claim 1, in which the trailing aerofoil is mounted to a vessel for free rotation about an upright axis, the leading aerofoil pivoting about the trailing aerofoil, and the assembly further including a tail aerofoil for trimming the assembly, the tail being mounted on a boom extending from the trailing aerofoil.

* * * * *